United States Patent [19]

Karoll

[11] 4,020,889

[45] May 3, 1977

[54] APPARATUS FOR MANIPULATING A MULTIPLE PANEL SCREEN

[76] Inventor: Paul Karoll, 2027 Grandville Ave., Los Angeles, Calif. 90025

[22] Filed: Aug. 2, 1976

[21] Appl. No.: 710,373

[52] U.S. Cl. ..... 160/120

[51] Int. Cl.[2] ..... E06B 9/10

[58] Field of Search ..... 160/120, 121, 122, 184

[56] References Cited

UNITED STATES PATENTS

| | | | |
|---|---|---|---|
| 1,713,452 | 5/1929 | Schiff | 160/120 |
| 2,029,675 | 2/1936 | Schlamp | 160/121 |
| 2,140,049 | 12/1938 | Grauel | 160/121 |
| 2,581,433 | 1/1952 | North et al. | 160/120 |
| 3,444,919 | 5/1969 | Karoll | 160/184 |
| 3,701,376 | 10/1972 | Froget | 160/121 |

*Primary Examiner*—Peter M. Caun
*Attorney, Agent, or Firm*—William R. Piper

[57] ABSTRACT

An apparatus for manipulating a multiple panel screen is disclosed in my U.S. Pat. No. 3,444,919, issued May 20, 1969. The patent shows a plurality of identical panels for regulating the visibility and the amount of light and air to be admitted. Each panel has a plurality of vertical columns of apertures separated by spaced apart horizontal strips. The panels are hung from a roller-shaped head piece and they are spaced apart from each other. When the screen is in normal position the apertures in successive panels are in alignment to permit the greatest amount of visibility and light. Novel means is used for rocking the head piece about its axis for vertically shifting the panels and their apertures with respect to each other for altering the visibility and light controlled by the screen. Additional novel means is used for rotating the head piece for rolling up the panels thereon for raising the screen or for unrolling the panels when lowering the screen.

10 Claims, 10 Drawing Figures

FIG-4-
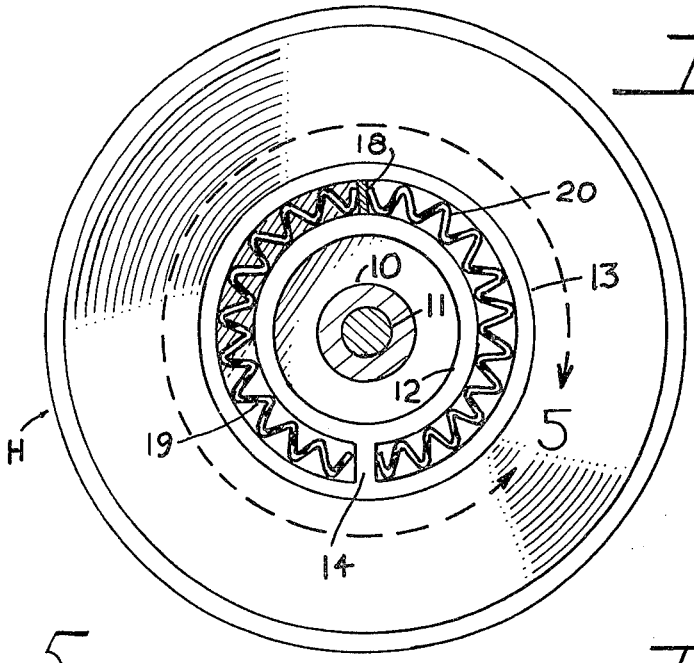
FIG-5-
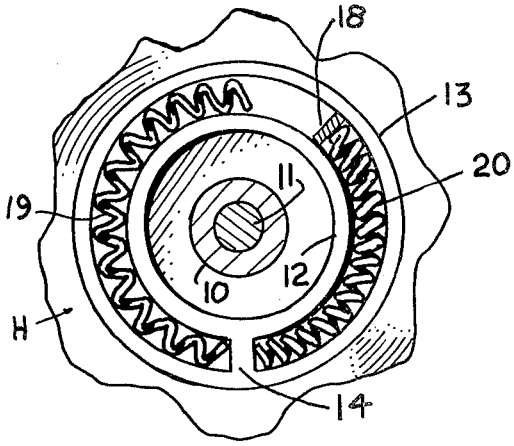
FIG-6-
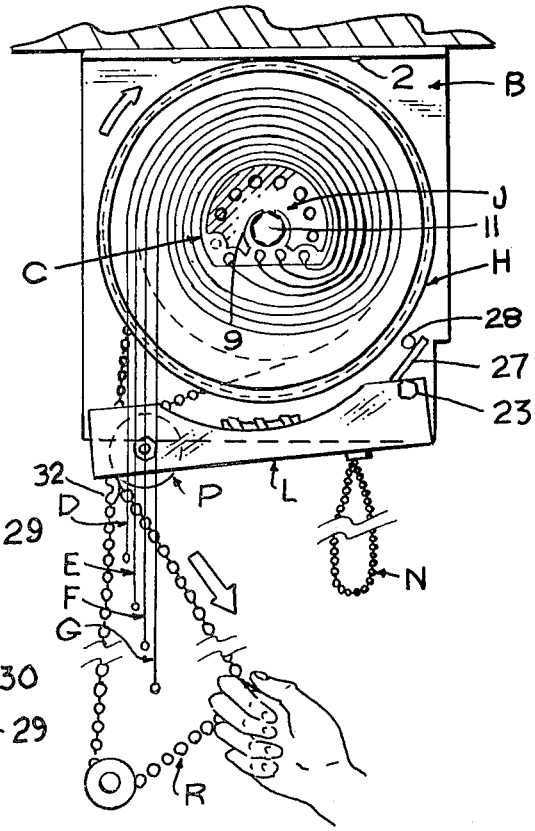
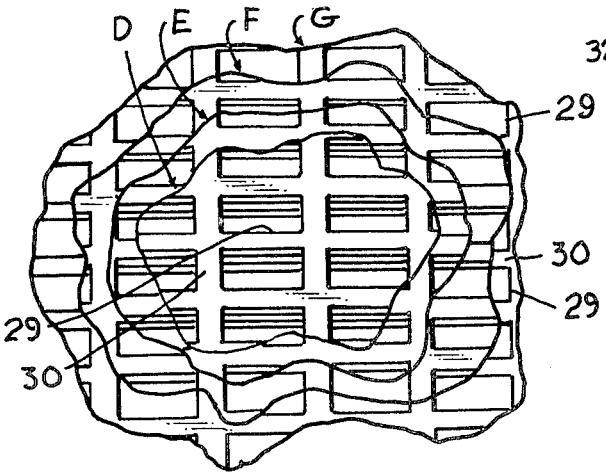
FIG-7-

APPARATUS FOR MANIPULATING A MULTIPLE PANEL SCREEN

SUMMARY OF THE INVENTION

An object of my invention is to provide an apparatus for controlling the visibility and the amount of light permitted to pass through a screen composed of a plurality of spaced apart panels, each having vertical columns of apertures separated by spaced apart horizontal strips. The panels forming the screen are supported at their upper edges by a roller shaped head piece which may be rotated for winding the panels thereon or unwinding them therefrom for raising or lowering the screen.

BRIEF DESCRIPTION OF THE DRAWINGS

FIG. 4 is another transverse section taken through a portion of the apparatus to show a face view of a worm gear from the opposite side of that of FIG. 3. The arrows associated with the section line 4—4 in FIG. 2 point to the face of the worm gear being viewed in FIG. 4.

FIG. 5 is a view of the double arrowed dashed circled portion of FIG. 4 and is made to illustrate how the two shock absorbing coil springs, mounted in the circular channel in the face of the worm gear, function.

FIG. 6 is still another transverse section on a smaller scale and taken along the line 6—6 of FIG. 2, to illustrate the rolled up position of the screen panels about the roller-shaped head piece when the screen is in raised position.

FIG. 7 is a front elevation of a portion of each of the four panels making up the screen when looking in the direction of the diverging dash lines as indicated by the arrows 7—7 of FIG. 3.

DESCRIPTION OF THE PREFERRED EMBODIMENTS

Figure 2:
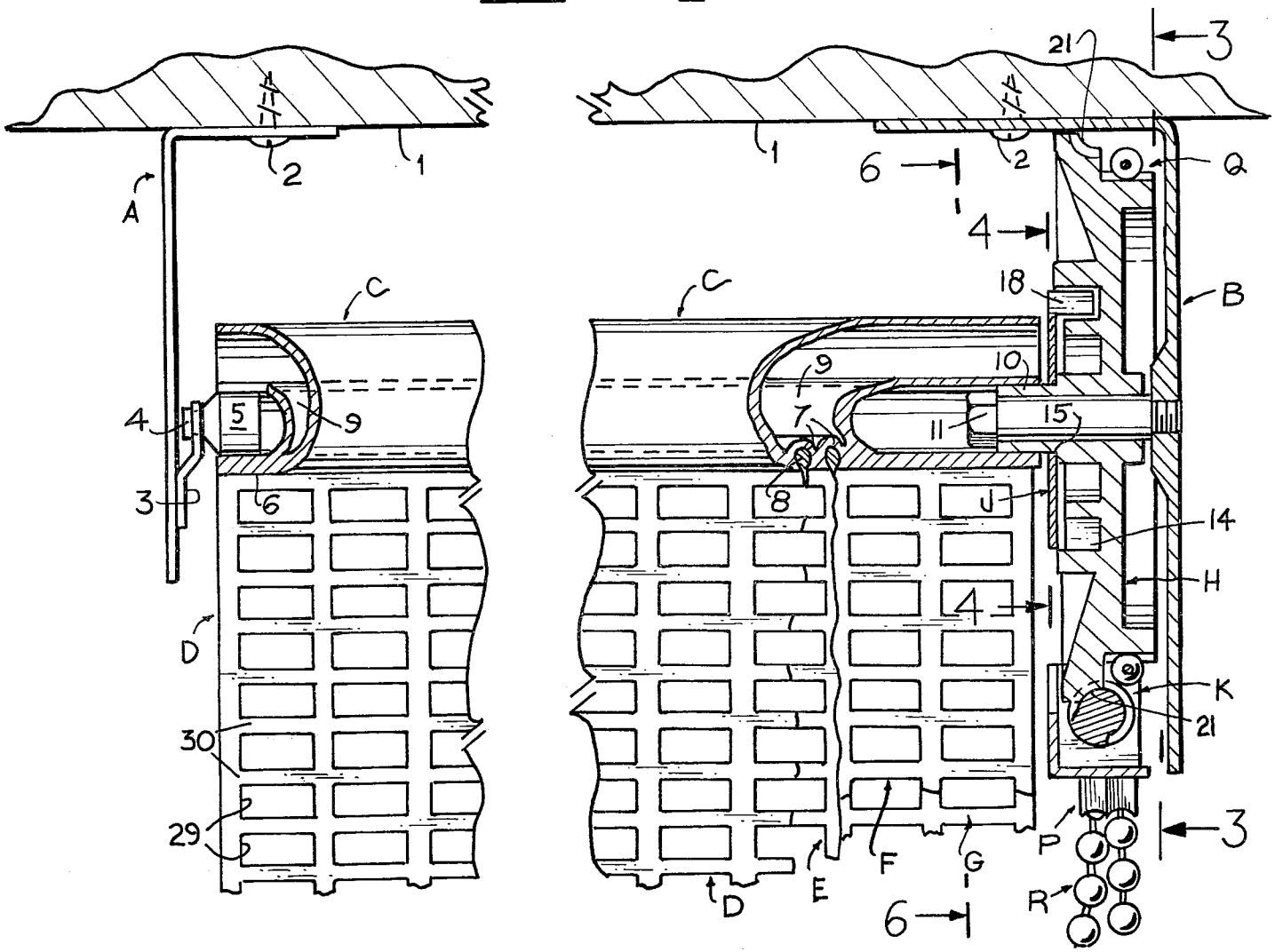
FIG. 2 is a front elevation of the apparatus with parts being shown in section.

In carrying out my invention I provide a pair of L-shaped brackets indicated at A, and B, in FIG. 2. Both brackets are secured to the top rail 1 of a window by screws 2. The bracket A has a steel fork 3 secured to the inner surface of its vertical portion and the fork receives a rotatable bearing 4 that is carried by a plug 5 which in turn is received in the left hand end of a roller-shaped head piece C.

Figure 1:
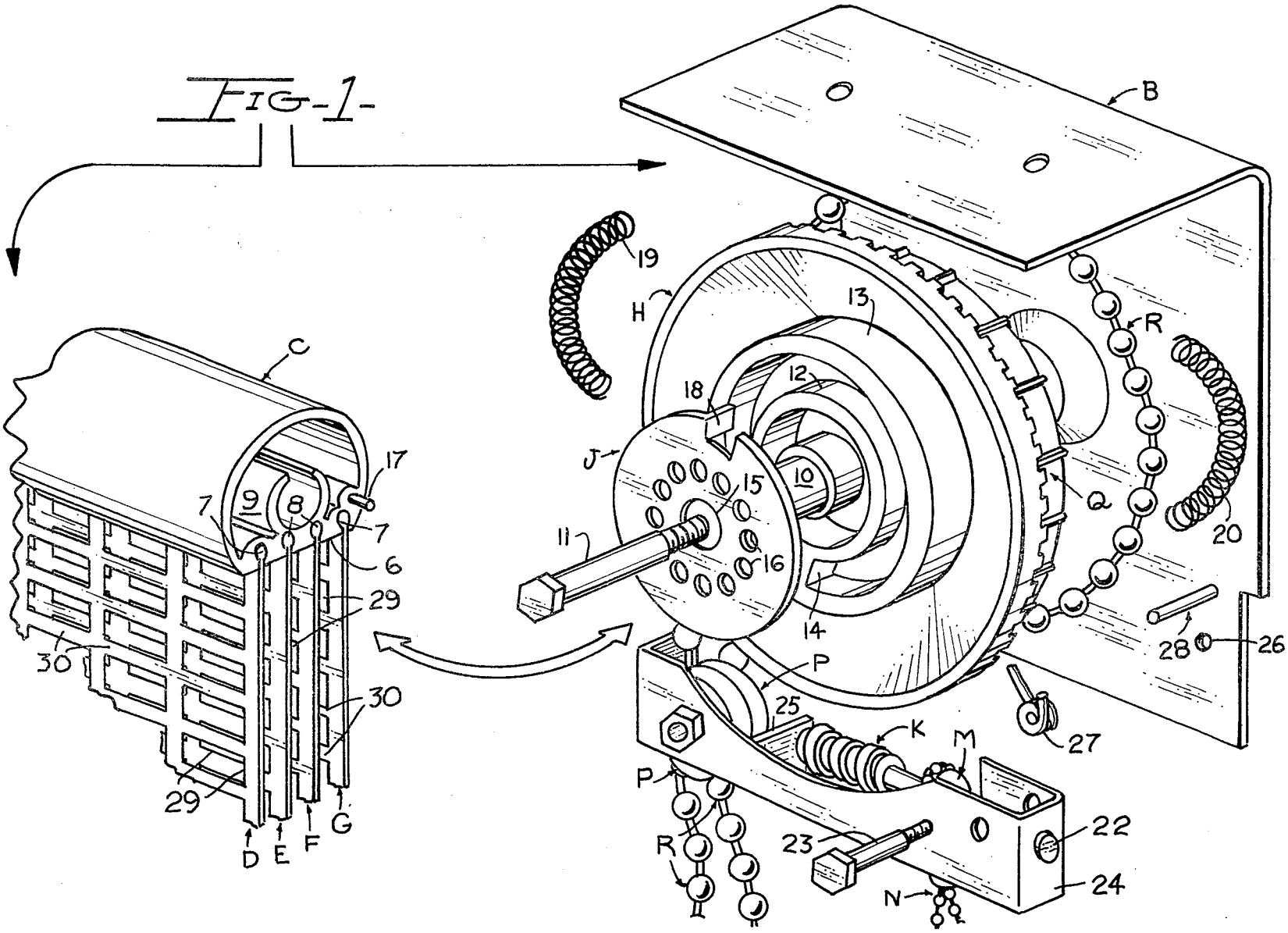
FIG. 1 is an exploded isometric view of the apparatus for supporting and manipulating the panels forming the screen.

An isometric view of the right hand end portion of the roller-shaped head piece C, is illustrated in the exploded view of FIG. 1. This head piece is formed from extended material such as plastic, aluminum etc., and it has a length so as to extend between the two brackets A and B. The head piece C, is substantially cylindrical in cross section and it has a flat underside 6 which is provided with a plurality of grooves 7 that extend throughout the length of the head piece. The grooves parallel each other and are spaced apart. Each groove 7 is key-shaped in cross section with a narrow entrance slot merging into an enlarged cylindrical interior. A plurality of identical panels D, E, F, and G have integral ribs 8 at their upper edges and the cylindrical shapes of these ribs is the same as that of the enlarged cylindrical interiors of the grooves 7. This permits the ribs 8 to be slipped into the grooves 7 whereby the panels are supported by the head piece C, as clearly shown in FIG. 1. Two or more panels may be used and I prefer using four panels which form the window screen or shade. I will explain hereinafter the panels more in detail.

The extruded roller-shaped head piece C has an inner semi-cylindrical portion 9 whose longitudinal axis coincides with the longitudinal axis of the roller-shaped outer cylindrical portion. The two wings of the semi-cylindrical portion 9 of the head piece C receive the plug 5 mounted therein at the left hand end of the head piece C. The right hand end of the head piece C, is supported by a mechanism that can rock the head piece into different angular positions for vertically adjusting the four panels for controlling the admitted light and visibility to see through the screen or the mechanism can be manipulated to roll all four panels of the screen around the head piece. This mechanism will now be described in detail.

A worm gear indicated generally at H, in FIG. 2, has a hub 10 which is mounted on a stud 11 that is screwed into a threaded opening provided in an embossed portion of the bracket B, see also FIG. 1. The left hand end of the hub 10 is received in the right hand end of the semi-cylindrical inner portion 9 of the roller-shaped head piece C so that a rotation of the worm gear H will rotate the head piece in a manner now to be described. The left hand face of the worm gear shown in FIG. 2 is illustrated in the exploded isometric view of FIG. 1 and is also shown in FIGS. 4 and 5. This face of the worm gear has two concentric circular flanges 12 and 13, whose center is the axis of the hub 10 and stud 11. The two circular flanges form a circular groove between them and a partition 14 extends between the two circular flanges and acts as a groove divider.

Referring again to FIGS. 1 and 2, it will be seen that I provide a washer J which has a central opening 15 to rotatably receive the hub 10 of the worm gear H. The washer has a plurality of openings 16 arranged in a circle whose center is the same as that of the washer. The right hand end of the roller-shaped head piece C has an integral pin 17 designed to enter any desired one of the openings 16 when the head piece is assembled on the hub. The washer J has a projection 18 bent at right angles to the plane of the washer, see FIG. 1, and designed to enter the circular groove formed between the two concentric flanges 12 and 13 and at a point substantially diametrically opposite from the portion 14, see FIG. 4.

A pair of shock absorbing coil springs 19 and 20 are placed in the circular groove formed between the concentric flanges 12 and 13. One end of each spring contacts the portion 14 that extends between the circular flanges and the other end of each spring normally contacts opposite sides of the projection 18 of the washer J, as shown in FIG. 4. I will explain how the shock absorbing springs 19 and 20 function after I set forth the structure for rocking the roller-shaped head piece C, into the desired angular position for adjusting the panels D to G, inclusive vertically with respect to each other and after I set forth the structure for rolling up all four panels around the head piece for raising the screen or shade or for unrolling the panels for lowering the screen.

Figure 3:
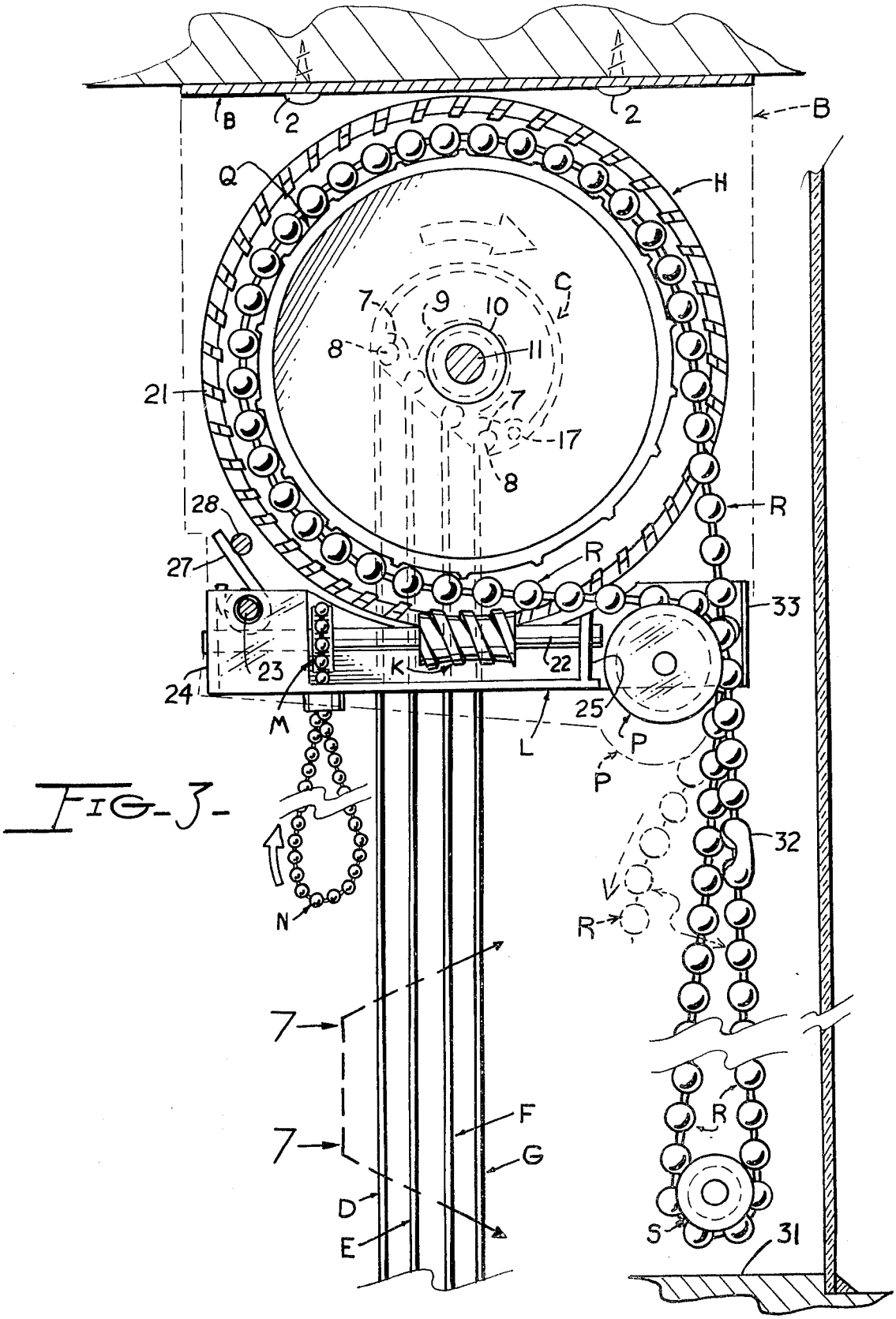
FIG. 3 is a transverse section through a portion of the apparatus and it is taken along the line 3—3 of FIG. 2 and looking in the direction of the arrows associated with the section line.
Figure 8:
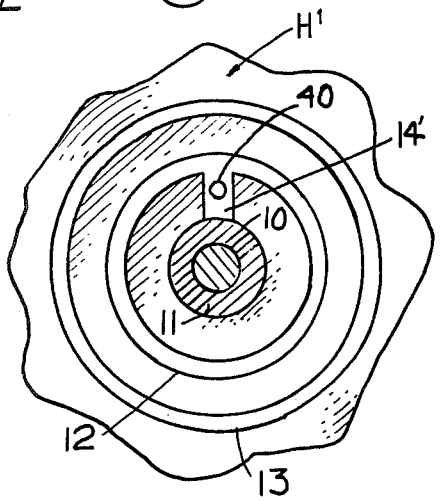
FIG. 8 is a view somewhat similar to FIG. 5, but shows a modified form of the worm gear where the shock absorbing springs of FIGS. 4 and 5 are not used.

In FIG. 3 I show an opposite face view of the worm gear H from that shown in FIG. 4 and it will be noted that the worm gear has teeth 21 in its periphery designed to be engaged by a worm K that is keyed to a shaft 22, see also FIG. 2. A swingable carriage L has one end pivotally mounted on a pin 23 and it has two upstanding walls 24 and 25 in which the ends of the shaft 22 are journalled. The exploded view of FIG. 1 shows that the pivot pin 23 for supporting the swinging carriage L could be a stud or bolt, the threaded portion of which is received in a threaded opening 26 in the bracket B. A torsion spring 27 is mounted on the pin 23 and has one end bearing against the carriage end wall 24 while the other end bears against a stop pin 28 carried by the bracket B, see FIG. 3. The torsion spring 27 yieldingly acts on the carriage L for normally maintaining the work K, in mesh with the teeth 21 of the worm gear H.

The means for rotating the worm K for in turn rotating the worm gear H is illustrated in FIG. 3. The shaft 22 has a sprocket M keyed thereto and the sprocket receives an endless small bead chain N that depends from the sprocket and is long enough to be readily reached and manipulated by a person standing by the multiple panel screen or shade. A movement of the chain N, in the direction of the arrows shown in FIG. 3 will rotate the worm K for rotating the worm gear H clockwise as shown by the arrow and this will rock the roller-shaped head piece C, into the angular position shown for shifting the panels D, E, F, and G, vertically with respect to each other.

It is best to mention at this time that the four panels D, E, F, and G, are identical to each other and each has a plurality of vertical columns of apertures 29, the apertures in each column being separated from the apertures in the same column by horizontal strips 30, see FIG. 2. When the head piece C, is in a position where its flat underside 6 lies in a horizontal plane as shown in the exploded view of FIG. 1, the apertures 29 in the four panels D to G inclusive will be in horizontal registration with each other and the maximum amount of light and vision through these apertures will be permitted. However, when the head piece C, is angularly rocked into the position shown in FIG. 3 where its flat underside 6 is swung into an inclined plane, the four panels will be shifted vertically with respect to each other and so will the apertures so as to reduce the amount of light and clear vision afforded by the partially overlapped apertures on adjacent panels. FIG. 7 is a front elevation through the four panels when looking in the direction of the arrows 7—7 in FIG. 3 and shows portions of the four panels and how the apertures in each partially overlapped apertures on adjacent panels. FIG. 7 is a front elevation through the four panels when looking in the direction of the arrows 7—7 in FIG. 3 and shows portions of the four panels and how the apertures in each partially overlap those in adjacent panels. I have shown rectangularly-shaped apertures 29, but they may take different shapes some of which are shown in FIGS. 5, 7 and 9 to 13 inclusive of my U.S. Pat. No. 3,444,919.

I have described how the amount of light and vision may be varied by manipulating the endless small bead chain N, and I will now describe the mechanism for winding up the four panels D to G inclusive about the roller-shaped head piece C, for raising the screen shade or for unwinding the panels from the head piece for lowering the screen. Again referring to FIG. 3 I show the free end of the pivoted carriage L provided with two single grooved pulleys P, mounted on a common shaft. The worm gear H has an integral sprocket Q for receiving an endless large bead chain R. The two strands of the large bead chain R that extend from the sprocket Q, are passed over the two grooved pulleys P, and then these two strands extend down to form a loop that is passed around a pulley S preferably mounted adjacent to the window sill 31.

When the operator wishes to rotate the roller-shaped head piece C for winding up the four panels D to G, inclusive, he pulls on the strand of the large bead chain R, as shown by the hand 32 in FIG. 6 to rotate the head piece in a clockwise direction. However, the initial pull on the chain R will pull downwardly on the two grooved pulleys P, and this will swing the carriage L downwardly about the pivot pin 23 to free the worm K from the worm gear H. This will free the worm gear H from the worm and a further pull on the chain R will rotate the worm gear and head piece for winding up the four panels on the head piece. FIG. 3 shows the two ends of the endless chain R, interconnected by the standard large connecting link 32 and this connecting link is placed in such a position on the endless chain that when the four panels are rolled up onto the head piece C, the connecting link 32 will reach the double grooved pulley P. This pulley P, is placed so close to the end wall 33 of the carriage L that the connecting link 32 will become jammed between the pulley and the end wall 33 and will stop any further winding up of the four panels. In this simple way the winding up of the four panels on the head piece C, is stopped before the head piece can continue rotating to carry the four panels beyond the point where they are all wound upon the head piece and the screen or shade is in raised position.

The shock absorbing springs 19 and 20 come into play during the rolling up of the four panels D to G, inclusive on the head piece C for raising the screen and also for unrolling the panels from the head piece, see FIGS. 4 and 5. They also come into play when the small link chain N is operated for changing the angular position of the flat underside 6 of the roller-shaped head piece C. When the worm gear H, is rotated clockwise in FIG. 3 either by the worm K, or by the large link chain R, the washer J will not immediately start rotating clockwise until the partition 14 in the worm gear H, see FIG. 4 will start compressing the coil spring 19 against the projection 18 of the washer. As soon as the compressed spring 19 builds up sufficient force to overcome the inertia for rotating the head piece C, the the projection 18 and washer J will start to rotate and cause the pin 17, which is received in one of the holes 16 in the washer, to rotate the head piece C. On the other hand, when the worm gear H, is rotated in a counterclockwise direction by either the worm K or the large link chain R, the projection 18 of the washer J will remain stationary until the partition 14 of the worm gear H compresses the coil spring 20 until a force sufficient to move the projection counterclockwise, see FIG. 5, is built up whereupon the projection 18 and washer will move counterclockwise and cause the head piece C to rotate therewith.

It might be well at this point to state that when the operator desires to lower a rolled up screen on the head piece C, he will pull the strand of the large link chain R that will rotate the worm gear H, in a counterclockwise direction when looking at FIG. 6. The initial pull on the chain R will exert a downward force on the two grooved pulleys P and cause the pivoted carriage L to overcome the force of the torsion spring 27 and swing downwardly about the pin 23 to disengage the worm K from the teeth 21 on the worm gear H. Further downward pull on the right strand of the large link chain R will rotate the worm gear and with it the head piece C to lower the screen so that the four panels D to G inclusive, will cover the window area to the desired extent.

In certain cases it may not be desirable to provide shock absorbing springs 19 and 20 for the worm gear H but instead to directly connect the roller-shaped head piece C to the worm gear. In such a case the worm gear $H^1$ will take the place of the worm gear H. The partition $14^1$ will have a bore 40 therein for directly receiving the pin 17 of the head piece C, and the washer J will not be used. When this change is made, any rotation of the modified worm gear $H^1$ in either a clockwise or counterclockwise direction will immediately cause a similar rotation of the head piece C. There will be no shock absorbing lost motion between the worm gear $H^1$ and the head piece C. In all other respects the modified worm gear $H^1$ will be the same as the worm gear H. No further description of the operation of this modified apparatus need be given because it will be the same as set forth in the preferred form.

Figure 9:
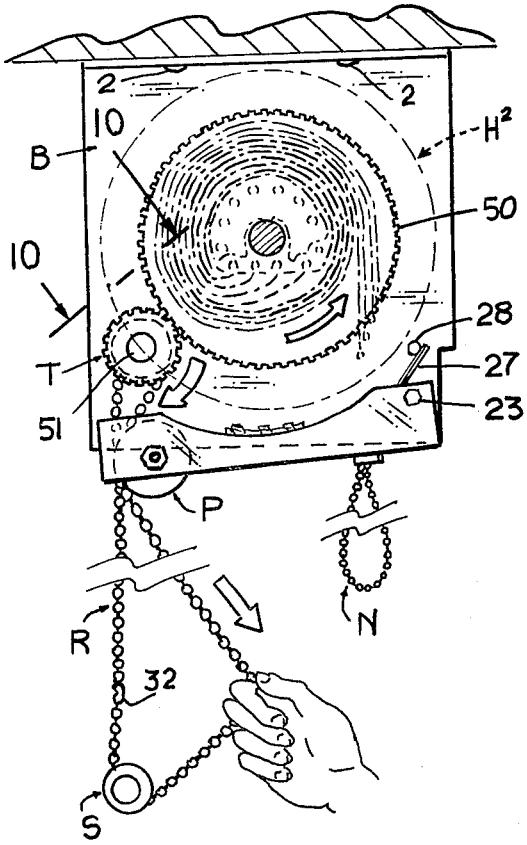
FIG. 9 is a transverse section through a slightly modified form of the apparatus for manipulating the multiple panel screen where the panels are extra heavy.
Figure 10:
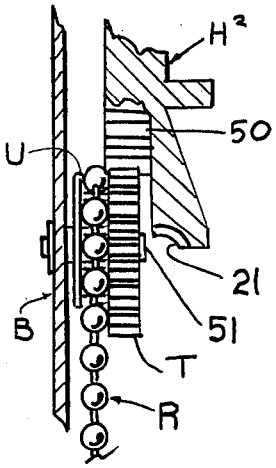
FIG. 10 is an enlarged longitudinal section through a portion of the apparatus shown in FIG. 9 and is taken along the line 10—10 of that Figure.

FIGS. 9 and 10 illustrate another modification of my apparatus. Where the panels are large in area and heavy in weight, I provide reduction gearing to make it possible for the operator to raise or lower all of the panels in unison. I make use of a modified worm gear $H^2$ and omit the large integral sprocket Q which is on the worm gear H, and substitute an external gear 50 which is integral with the worm gear $H^2$ and has the same axis. In all other respects the worm gear $H^2$ is similar to the worm gear H, or the modified worm gear $H^1$.

A spur gear T is rotatably mounted on a stub shaft 51, see FIGS. 9 and 10 which in turn is supported by the bracket B. The spur gear meshes with the teeth of an external gear 50 and it has an integral chain sprocket U around which the large link chain R, is passed. The diameter of the spur gear T, is much smaller than the diameter of the external gear 50 with the result that the spur gear must make a number of revolutions for each revolution of the external gear 50 and the worm gear $H^2$. In this way the rotation of the worm gear $H^2$ is geared down and it is possible for the operator to manipulate the raising or lowering of the heavy panels D to G, inclusive, shown in FIG. 9, by operating the large bead chain R, in the same manner as outlined for the worm gear H. FIG. 10 shows the worm gear $H^2$ provided with the worm gear teeth 21 designed to mesh with the worm K. The angular rocking of the head piece C can be accomplished by the manipulation of the small bead chain N, in the same manner as already described for the worm gear H shown in FIG. 3.

In all forms of the apparatus shown in the present drawings the raising and lowering of all panels simultaneously is done by actuating the large bead chain R by hand. It is possible to do this by a motorized mechanism, not shown, so that a pressing of one button, not shown, would close an electric circuit for raising the panels and a pressing of another button, not shown, would close the circuit for lowering all of the panels.

I claim:

1. An apparatus for manipulating a multiple panel screen and comprising:

a. an elongated head piece for supporting a plurality of flexible panels forming the screen;

b. a first means for connecting the top ends of said panels to said head piece in spaced parallel relation to one another;

c. a rotatable member operatively connected to said head piece for rotating the head piece on its longitudinal axis for initially shifting said panels vertically with respect to each other and then for rolling the panels onto said head piece for rolling up the screen;

d. a second means for initially rocking said member for rocking said head piece for altering the vertical positions of said panels with respect to each other; and e. a third means for first disconnecting said member rocking means from said rotatable member and then for rotating said member for winding up said panels on said head piece for rolling up the screen.

2. The combination as set forth in claim 1: and in which a. said rotatable member has worm gear teeth concentric with its axis of rotation;

b. said second means for initially rocking said rotatable member includes a spring biased swingable carriage with a worm normally meshing with said worm gear teeth; and c. means for rotating said worm for rotating said member for rocking said head piece through a desired angle for shifting said panels vertically with respect to each other.

3. The combination as set forth in claim 2: and in which a. said carriage has a pivot disposed on one side of said worm and has a pair of pulleys rotatable about a common shaft that is disposed on the opposite side of said worm;

b. said third means that first disconnects said first means from said rotatable member includes a chain having a portion extending around and operatively engaging with said rotatable member and having first and second chain portions passing around said pair of pulleys, the remaining first and second portions of said chain depending from said pulleys;

c. whereby a pull on the first chain portion, which will rotate said rotatable member in a direction to wind up said panels on said head piece, will first exert a downward pull on its associate pulley for swinging said carriage about its pivot for freeing said worm from said worm teeth and thus disengage said rotatable member from said worm, and a further pull on said first chain portion will rotate said member and said head piece for rolling up said panels on said head piece.

4. The combination as set forth in claim 3: and in which a. a stop member on said second chain portion and coming into contact with its associate pulley and said carriage for preventing any further movement of the first chain portion in the same direction, the stop member on said second chain portion thus engaging with the pulley and said carriage when said head piece has rotated sufficiently to entirely wind up said panels thereon, the spring biased carriage swinging said worm into mesh with the worm teeth for locking said rotatable member and said head piece from accidental rotation.

5. The combination as set forth in claim 4: and in which a. a downward pull on said second chain portion will initially pull on its associate pulley to swing said carriage and free said worm from said worm teeth and a further pull on said second chain portion will rotate said rotatable member and said head piece in a direction to unwind said panels from said head piece to the desired extent.

6. An apparatus for manipulating a multiple panel screen and comprising:

a. a first and a second bracket spaced apart and a stud carried by said second bracket;

b. a worm gear rotatably mounted on said stud and having an integral hub;

c. a roller-shaped elongated head piece having one end rotatably mounted on said hub and having a pin extending into an opening in said worm gear for connecting the two together so that said head piece and worm gear will rotate as a unit, the other end of said head piece being rotatably supported by said first bracket;

d. a plurality of flexible panels having apertures therein and means for connecting the top ends of said panels to said head piece in spaced parallel relation to one another;

e. a spring biased elongated carriage having one end pivotally connected to said second bracket and rotatably supporting a shaft which carries a worm that is yieldingly held in mesh with said worm gear, said carriage rotatably supporting a pair of pulleys positioned at the opposite end of the carriage from its pivotal connection with said second bracket;

f. means for rotating said worm for rotating said worm gear and rocking said head piece for shifting said panels vertically with respect to each other for controlling the light and visibility through the apertures in said panels;

g. said worm gear having an integral chain-receiving gear whose center is concentric with the center of said worm gear;

h. a chain having a portion passed over said chain-receiving gear so that a movement of the chain portion contacting with said chain gear will rotate said chain gear, worm gear and head piece about their common axis, said chain having first and second chain portions passed around said pulleys and depending therefrom;

i. whereby a pull on the first chain portion designed to rotate said chain gear, worm gear and head piece in a direction for winding up said panels on said head piece, will first exert a downward pull on its associate pulley and carriage for swinging said carriage about its pivot for freeing said worm from said worm gear, and a further pull on said first chain portion will rotate said chain gear, worm gear and head piece for rolling up said panels on said head piece to the desired extent.

7. The combination as set forth in claim 6: and in which a. a stop member positioned on said second chain portion for coming into contact with its associate pulley and said carriage for preventing any further movement of said first and second chain portions in the same directions when said head piece has entirely wound said panels thereon, the spring biased carriage swinging back into normal position and causing said worm to mesh with said worm gear for preventing any rotation of said chain gear, worm gear and head piece.

8. The combination as set forth in claim 7: and in which a. a downward pull on said second chain portion will initially pull on its associate pulley to swing said carriage and free said worm from said worm gear and a further pull on said second chain portion will rotate said chain gear, worm gear and head piece in a direction to unwind said panels from said head piece to the desired extent after which said spring biased carriage will return to normal position and cause said worm to mesh with said worm gear for preventing said worm gear and head piece to rotate.

9. The combination as set forth in claim 6: and in which a. a yielding shock absorbing spring means interconnects said pin on said head piece with said worm gear so that there will be a partial lost rotating motion between said worm gear and said head piece before the two will rotate as a unit whether the rotation of said worm gear is clockwise or counterclockwise.

10. An apparatus for manipulating a multiple panel screen and comprising:

a. a first and second bracket spaced apart and a stud carried by said second bracket;

b. a worm gear rotatably mounted on said stud and having an integral hub;

c. a roller-shaped elongated head piece having one end rotatably mounted on said hub and having a pin extending into an opening in said worm gear for connecting the two together so that said head piece and worm gear will rotate as a unit, the other end of said head piece being rotatably supported by said first bracket;

d. a plurality of flexible panels having apertures therein and means for connecting the top ends of said panels to said head piece in spaced parallel relation to one another;

e. a spring biased elongated carriage having one end pivotally connected to said second bracket and rotatably supporting a shaft which carries a worm that is yieldingly held in mesh with said worm gear, said carriage rotatably supporting a pair of pulleys positioned at the opposite end of the carriage from its pivotal connection with said second bracket;

f. means for rotating said worm for rotating said worm gear and rocking said head piece for shifting said panels vertically with respect to each other for controlling the light and visibility through the apertures in said panels;

g. said worm gear having an integral gear whose center coincides with the center of said worm gear;

h. a spur gear rotatably carried by said second bracket and meshing with said integral gear on said worm gear and being much smaller in diameter than said worm gear;

i. said spur gear having an integral chain-receiving gear whose center is concentric with the center of said gear;

j. a chain having a portion passed over said chain-receiving gear so that a movement of the chain portion contacting with said chain gear will rotate said chain gear, spur gear, worm gear and head piece, said chain having first and second chain portions passed around said pulleys and depending therefrom;

k. whereby a pull on the first chain portion designed to rotate said chain gear, spur gear, worm gear and head piece in a direction for winding up said panels on said head piece, will first exert a downward pull on its associate pulley and carriage for swinging said carriage about its pivot for freeing said worm from said worm gear, and a further pull on said first chain portion will rotate said chain gear and spur gear for causing the larger diameter integral gear with the worm gear to rotate at a much slower speed and thereby causing the head piece to revolve at a slower speed for rolling up said panels on said head piece to the desired extent.

* * * * *